US006098581A

United States Patent [19]

Buck et al.

[11] Patent Number: 6,098,581

[45] Date of Patent: Aug. 8, 2000

[54] VARIABLE VALVE CONTROL FOR PISTON INTERNAL COMBUSTION ENGINE

[75] Inventors: Walter Buck, Ludwigsburg; Alexander Hiereth, Esslingen, both of Germany

[73] Assignee: DaimlerChrysler AG, Stuttgart, Germany

[21] Appl. No.: 09/173,388

[22] Filed: Oct. 15, 1998

[30] Foreign Application Priority Data

Oct. 16, 1997 [DE] Germany ..... 197 45 761

[51] Int. Cl.[7] ..... F01L 1/34; F01L 13/00

[52] U.S. Cl. ..... 123/90.17; 123/90.27; 123/90.39

[58] Field of Search ..... 123/90.15, 90.16, 123/90.17, 90.27, 90.31, 90.39, 90.4

[56] References Cited

U.S. PATENT DOCUMENTS

| | | | |
|---|---|---|---|
| 4,535,733 | 8/1985 | Honda | 123/90.17 |
| 4,546,735 | 10/1985 | O'Neal | 123/90.17 |
| 4,662,323 | 5/1987 | Moriya | 123/90.23 |
| 4,862,845 | 9/1989 | Butterfield et al. | 123/90.15 |
| 5,052,350 | 10/1991 | King | 123/90.16 |
| 5,163,390 | 11/1992 | Shimamoto | 123/90.27 |
| 5,178,105 | 1/1993 | Norris | 123/90.15 |
| 5,431,132 | 7/1995 | Kreuter et al. | 123/90.16 |
| 5,555,860 | 9/1996 | Wride | 123/90.16 |
| 5,586,527 | 12/1996 | Kreuter | 123/90.15 |
| 5,592,906 | 1/1997 | Kreuter et al. | 123/90.16 |

FOREIGN PATENT DOCUMENTS

| | | |
|---|---|---|
| 29 19 213 | 11/1980 | Germany . |
| 43 22 480 | 1/1995 | Germany . |
| 196 00 536 | 7/1997 | Germany . |
| 197 01 203 | 7/1998 | Germany . |
| 7-063022 | 3/1995 | Japan . |
| 2 301 398 | 12/1996 | United Kingdom . |

*Primary Examiner*—Weilun Lo
*Attorney, Agent, or Firm*—Klaus J. Bach

[57] ABSTRACT

In a variable valve control arrangement for an internal combustion engine including a cylinder head with a first camshaft having exhaust valve operating cams and intake valve opening cams, a second camshaft having intake valve closing cams, exhaust valve operating rocker arms pivotally supported on a rocker arm support shaft mounted on the cylinder head in a force transmitting relation with the exhaust cams of the first camshaft, intake operating rocker arms mounted on the same rocker arm support shaft, and engagement members disposed on the intake valve operating rocker arms and in contact with the intake cams of both camshafts for the transmission of the intake valve opening control movement of the first camshafts and the intake valve closing control movement of the second camshaft to the intake valves, the rocker arm support shaft is disposed below the first camshaft and is supported by bearing blocks disposed in the area between adjacent cylinders and by an additional support structure formed in the middle between adjacent bearing blocks on a well extending from the cylinder head.

14 Claims, 4 Drawing Sheets

VARIABLE VALVE CONTROL FOR PISTON INTERNAL COMBUSTION ENGINE

BACKGROUND OF THE INVENTION

The invention relates to a variable valve control arrangement for piston-type internal combustion engines having cylinders with a cylinder head including exhaust valves and intake valves whose opening period is adjustably controlled by two camshafts whose angular positions relative to each other are adjustable during operation of the engine.

Valve operating mechanisms for piston-type internal combustion engines are known in various arrangements. In practice, the intake valves and the exhaust valves are operated generally by a common camshaft, but it is also known to provide separate camshafts for operating the intake and exhaust valves. The valves are actuated directly by the cams of the respective camshaft or they are operated by the cams by way of intermediate rocker arms.

Also variable valve control arrangements are known, for example from DE 43 22 480 C2, particularly for the intake valves of piston-type internal combustion engines wherein the intake valves are controlled by two camshafts of which one has the function of opening the inlet valves and the other has the function of closing the intake valves, and the relative phase positions of the two camshafts can be changed by a controllable coupler drive disposed between the two camshafts depending on engine operating parameters. The cams of the two camshafts controlling the intake valves act on a common engagement member which is disposed on a valve operating rocker arm which is supported so as to move in a plane extending normal to the axes of the camshafts. The intake valves of the cylinder of the internal combustion engine are operated by the respective rocker arms.

DE 197 01 203.5 already discloses a variable valve control for a piston-type internal combustion engine with exhaust valves operated by a camshaft by way of rocker arms and with two additional camshafts of which one controls the intake valve opening functions and the other, the intake valve closing functions. This arrangement results in a relatively wide cylinder head and is relatively expensive as it requires a large number of parts.

It is the object of the present invention to provide a variable valve operating mechanism for piston-type internal combustion engines which requires less space and which is less expensive than the prior art arrangements.

SUMMARY OF THE INVENTION

In a variable valve control arrangement for an internal combustion engine including a cylinder head with a first camshaft having exhaust valve operating cams and intake valve opening cams, a second camshaft having intake valve closing cams, exhaust valve operating rocker arms pivotally supported on a rocker arm support shaft mounted on the cylinder head in a force transmitting relation with the exhaust cams of the first camshaft, intake operating rocker arms mounted on the same rocker arm support shaft, and engagement members disposed on the intake valve operating rocker arms and in contact with the intake cams of both camshafts for the transmission of the intake valve opening control movement of the first camshafts and the intake valve closing control movement of the second camshaft to the intake valves, the rocker arm support shaft is disposed below the first camshaft and is supported by bearing blocks disposed in the area between adjacent cylinders and by an additional support structure formed in the middle between adjacent bearing blocks on a wells extending from the cylinder head.

With the arrangement, not only the number of camshafts required is reduced, but the support arrangement for the valve operating levers, that is the rocker arms is also simplified and less expensive and the space requirements for the valve operating mechanism are greatly reduced. Particularly greater freedom is achieved herewith in the placement of the camshafts above the row of cylinders. A particularly simple and space-saving solution resides in the arrangement of the intake-exhaust camshaft in the area of the longitudinal center axis of the internal combustion engine that is longitudinally in the center above the combustion chambers. In this way, the second camshaft can be disposed in a space-saving manner, above the intake valves while, on the other side of the combined intake-exhaust camshaft, there is a free space for the accommodation for spark plugs and/or fuel injection nozzles. Furthermore, a symmetric arrangement of the valve operating mechanism is achieved also with respect to the support for, and the length of, the valve operating rocker arms. It is further in accordance with the invention considered to be advantageous for the intake-exhaust camshaft to be assigned the intake valve opening function while the intake valve closing function is assigned to the second camshaft which is driven by the intake-exhaust camshaft by way of an adjustable coupler drive. The intake-exhaust camshaft is driven by the crankshaft. Such an arrangement wherein the intake camshaft with the intake valve closing function is driven by the intake-exhaust camshaft makes it also possible if desired to provide a control arrangement by way of which the phase relation of the intake-exhaust camshaft can be adjusted relative to the crankshaft, possibly even separately for the intake cams and the exhaust cams of the intake-exhaust camshaft.

With the arrangement of the intake-exhaust camshaft essentially in the center above the row of cylinders of the internal combustion engine, it is advantageous to arrange the pivot axis of the intake and exhaust valve operating rocker arms in the area of the longitudinal center axis of the internal combustion engine, preferably in such a manner that the axis of the intake-exhaust camshaft and the pivot axis of the intake and exhaust valve operating rocker arms are disposed essentially in the longitudinal centerplane of the internal combustion engine.

With this arrangement, the engagement members which are contacted by the intake cams and which engage the intake valve operating rocker arms and also the exhaust valve operating rocker arms are contacted by the cams at about the same level and with only little sideways displacement from the vertical longitudinal center plane of the intake-exhaust camshaft. This results in a force transmission which is advantageous for the intake-exhaust camshaft and generates relatively low bearing forces.

Preferably, the camshafts and the valve operating rocker arm support shaft are supported on support blocks disposed in the areas between adjacent cylinders and the shaft supporting the rocker arms is additionally supported between adjacent support blocks preferably by wells which are disposed between the support blocks near the exhaust valves and adapted to receive spark plugs or fuel injection nozzles.

Further features of the arrangement according to the invention will become apparent from the following description on the basis of the accompanying drawings.

DESCRIPTION OF PREFERRED EMBODIMENTS

Figure 1:
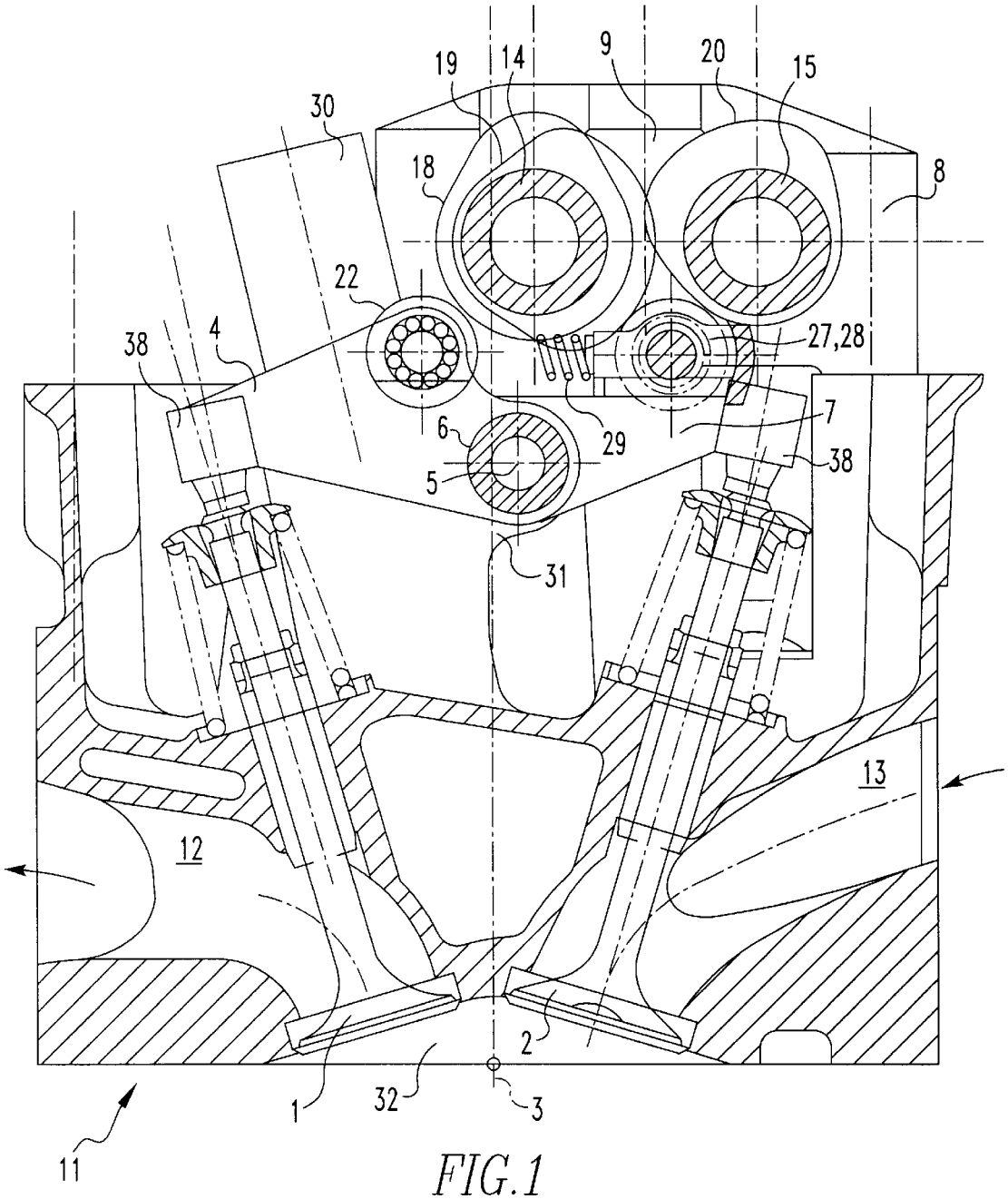
FIG. 1 is a cross-sectional view of a cylinder head taken along line 1—1 of FIG. 2.
Figure 2:
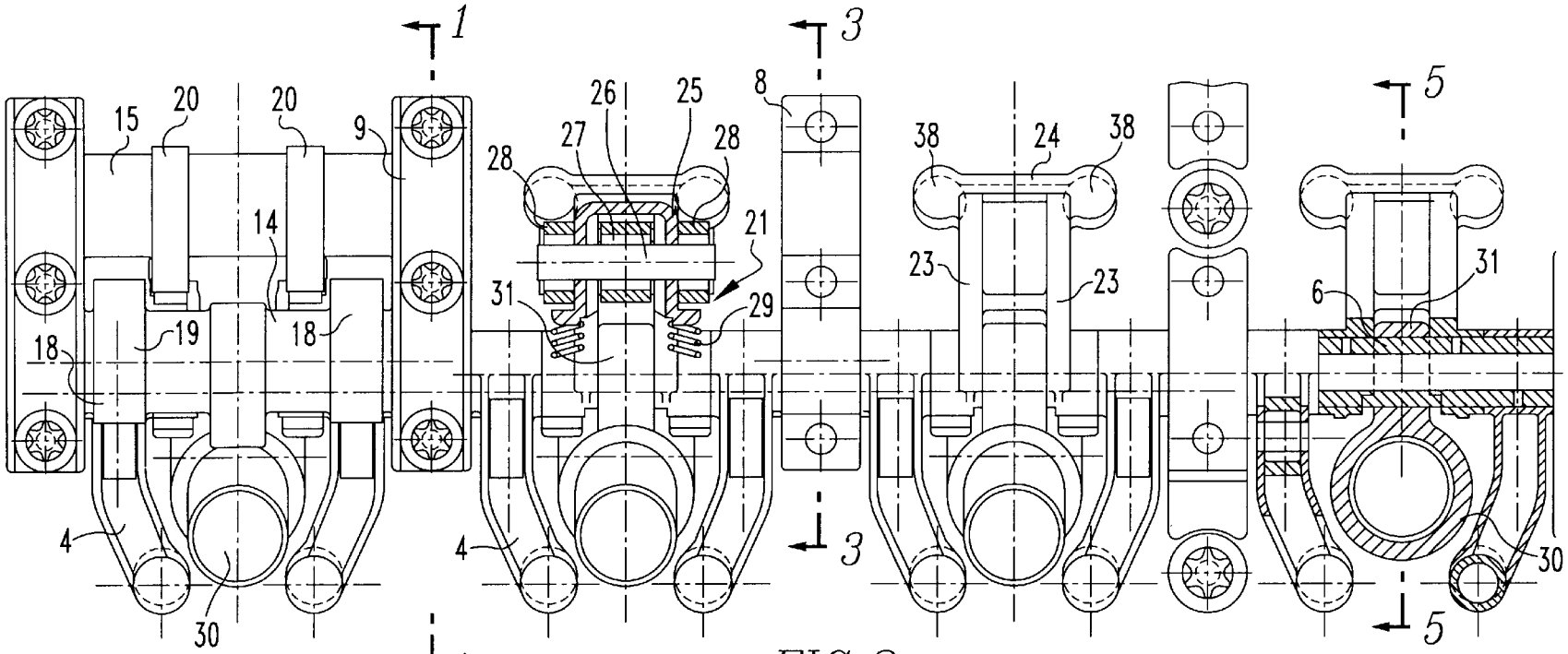
FIG. 2 is a top view of the cylinder head as shown in FIG. 1 with elements removed from some cylinders to better show various features.

The internal combustion engine shown in the figures as an exemplary embodiment includes four valves per cylinder, that is, two intake and two exhaust valves. In the cross-sectional representation of FIG. 1 however only one exhaust valve 1 and one intake valve 2 are shown. The exhaust valves and the intake valves are disposed opposite one another with respect to the longitudinal center plane 3 of the internal combustion engine in which the center axes of the cylinders are disposed which however are not shown in the drawings. The exhaust valves 1 are operated by valve operating elements which are in the form of rocker arms and which are supported on a tubular bearing shaft 6 so as to pivot about the pivot axis 5. The intake valves are operated by valve operating elements 7, which are rocker arms also supported by the bearing shaft 6 so as to be pivotable about the axis 5. Hydraulic play compensating elements 38 are arranged between the valves 1, 2 and the rocker arms 4, 7 in a known manner. In accordance with the arrangement of the intake valves 2 and the exhaust valves on one and, respectively, the opposite side of the longitudinal center plane 3, the rocker arms extend from the common pivot axis 5 which is disposed close to the longitudinal center plane 3 toward the respective intake and exhaust valves. As indicated in FIG. 2, the rocker arms 4 and 7 (not shown in FIG. 2) for each of the cylinders are disposed between the bearing blocks 8, 9 which are arranged between adjacent cylinders and at the opposite ends of the cylinder head. The bearing blocks 8, 9 can be components of a common bearing structure, which is mounted onto the part 10 (FIGS. 3, 4) of the cylinder head which is designated altogether by the numeral 11 and which includes the guides for the valves 1 and 2 and also the exhaust and intake passages 12 and 13. The bearing blocks comprise bottom and top parts 8, 9 which together are bolted onto the part 10 of the cylinder head. In accordance with the invention, the cylinder head may also be divided into a lower and an upper cylinder head part which include the lower and upper bearing halves, respectively, so that no special bearing blocks are necessary. The cylinder head 11 extends over the full length of the internal combustion engine. The bearing blocks 8, 9 support the camshafts 14 and 15 of which the camshaft 14 is disposed above the tubular bearing shaft for the valve operating rocker arm 4 and 7. The axis of rotation 16 of the camshaft 14 is also disposed near the longitudinal center plane 3 and extends parallel thereto. The axis of rotation 17 of the camshaft 15 extends parallel to, and at the same level of, the axis of rotation 16 of the camshaft 14 wherein the camshaft 15 is displaced in the direction toward the intake side toward the camshaft 14. The axis of rotation 16 of the camshaft 14 and the pivot axis 5 of the rocker arms 4 and 7 are disposed at the same side of the longitudinal center plane 3, the displacement of the pivot axis 5 from the longitudinal center plane 3 being less than the displacement of the axis of rotation 16 of the camshaft 14.

The camshaft 14 carries intake and exhaust valve actuating cams that is between two bearing blocks 8, there are two exhaust cams 18 arranged adjacent the bearing blocks 8 and in the middle between the two exhaust cams 8, there is an intake cam 19. The cam shaft 15 includes intake cams 19 and intake cams 20 arranged in spaced relationship from the intake cams 19.

The intake cams 19 and 20 together act on the rollers 27 and 28 of an engagement member 21, which is slideably supported on the intake valve operating rocker arm 7. The exhaust cams 18 operate the exhaust valve operating rocker arms 4 by way of actuating rollers 22 supported thereon.

The cam exhaust-intake camshaft 14 is driven by the crankshaft in a well-known manner and the camshaft 15 is driven by the camshaft 14 by way of a phase-variable drive which permits a change of the phase relationship between the two camshafts. Such drives are well known in the field and consist for example of a four wheel coupler drive. In this way, the opening periods of the intake valves can be controlled as the intake valves are opened by the intake cams 19 on the first camshaft but are closed by the intake cams 20 on the second camshaft.

In the arrangement described therein, the rocker arms 7 for the intake valves 2 are combined to a two-legged U-shaped lever wherein the two legs 23 are interconnected by a transverse web 24 for operating the two intake valve 2 of a cylinder. The two legs 23 form slide guides for the engagement member 21 which includes a bridge structure 25. The bridge structure carries a shaft 26 extending in a direction normal to the legs 23 and supporting at its center the engagement rollers 27 and, at opposite sides thereof, the engagement rollers 28. The center engagement roller 27 cooperates with the cam 19 of the camshaft 14 and the outer engagement rollers 28 cooperate with the cams 20 of the camshaft 15. The bridge structure 25 is biased by springs 29, which are disposed between the bridge structure 25 and a support structure on the legs 23, toward the camshaft 15 so that engagement of the engagement rollers 27, 28 with the respective cams 19 and 20 is ensured.

Since one of the camshafts, that is, the camshaft 14, carries the intake cams 19 and also the exhaust cams 18, the arrangement can be very compact. To this end, also the support shaft 6 supporting the rocker arms 4 and 7 should be light and relatively small in diameter. In order to make this possible, there is an additional support structure for the support shaft 6 of the rocker arms 4 and 7, which is disposed between the bearing blocks 8, 9. This support structure is provided by a bearing eye 31 (FIG. 5), which is formed on a well 30 for receiving a spark plug or a fuel injection nozzle. The well 30 has about the same inclination as the exhaust valves 1 and, in a side view, is disposed between the exhaust valves 1 and extends toward the center of the combustion chamber 32 in the cylinder head 10 between the intake and exhaust valves 1, 2. With the described arrangement of the well 30 as apparent from the top view of FIG. 2, the exhaust rocker arms 4 are curved such that their ends extend toward each other around the contour of the well 30.

Figure 3:
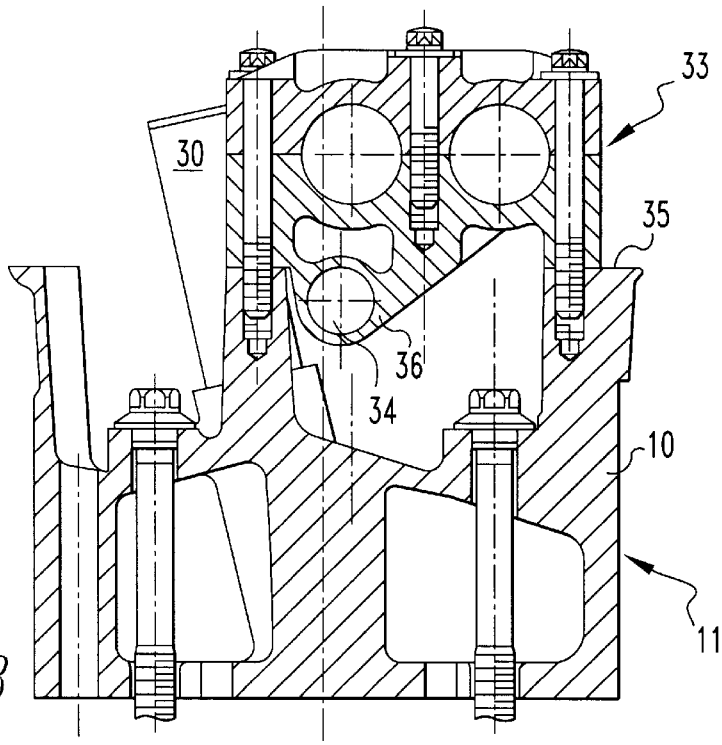
FIG. 3 is a cross-sectional view taken along line 3—3 of FIG. 2.

An arrangement as shown in FIG. 3 is particularly suitable if the bearing blocks which are designated in FIG. 3 by the reference numeral 33 are part of a bearing housing, but the arrangement is suitable also otherwise.

In this arrangement, the bearing blocks 33 receive and support the shaft which forms the support bearing 6 for the valve actuating rocker arms 4 and 7. For this purpose, the bearing blocks 33 include receiving bores 34 for the support shaft 6, wherein the receiving bores 34 are formed in a projection 36 extending beyond the jointure plane 35 of the bearing block 33 with the lower cylinder head part 10, which includes the valve guides. In such an embodiment, it is advantageous if also the corresponding part of the well 30 is part of the bearing structure which arrangement however is not shown in the drawings. Then the bearing structure can be preassembled with all the valve operating elements and can be mounted, preassembled, onto the lower part 10 of the cylinder head.

Figure 4:
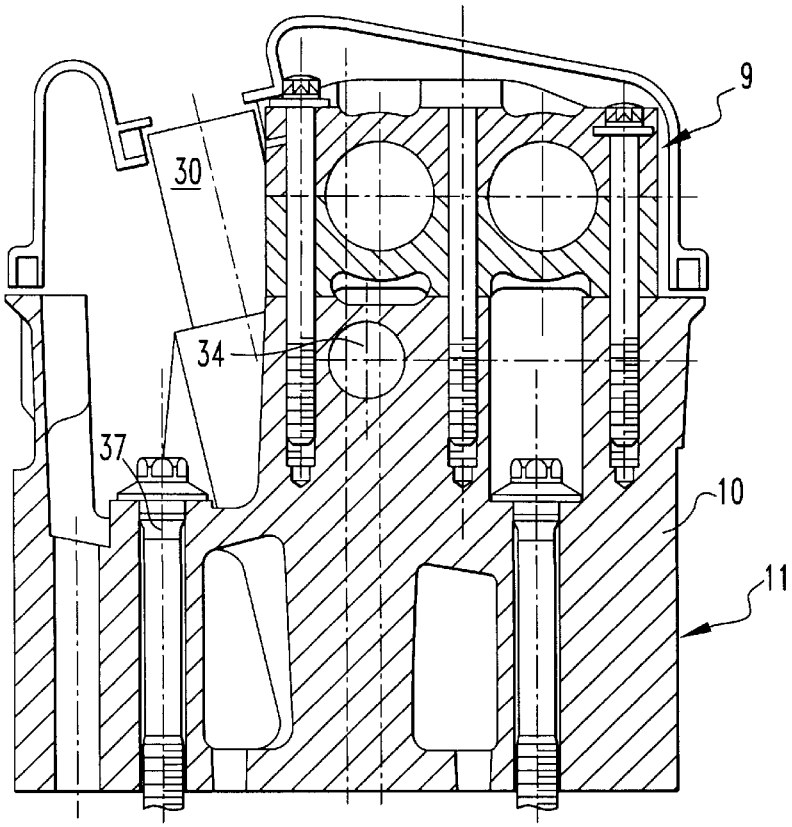
FIG. 4 is a cross-sectional view like that shown in FIG. 3 showing however another embodiment for the shaft supports.
Figure 5:
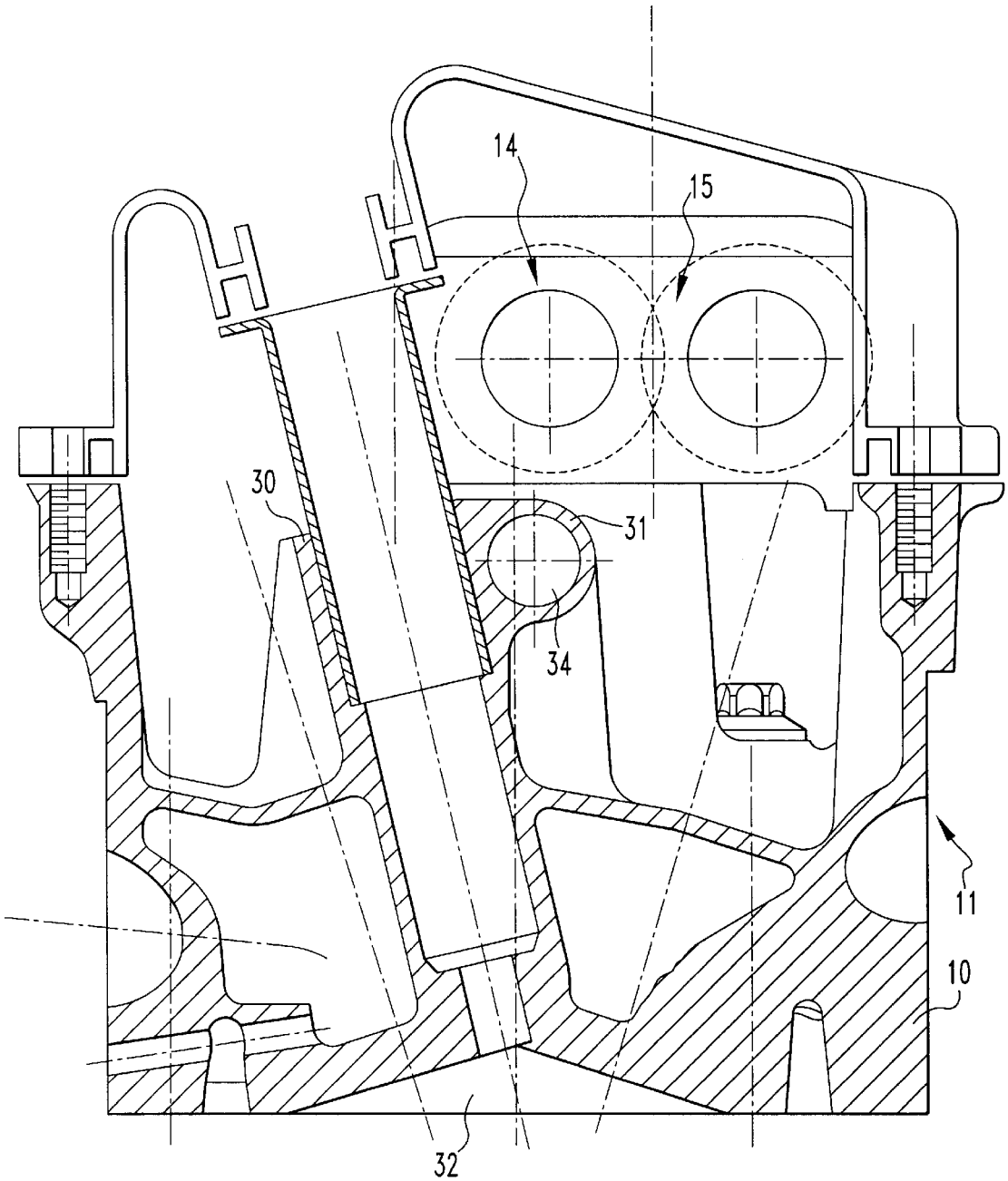
FIG. 5 is a cross-sectional view taken along line 5—5 of FIG. 2.

It is however, also possible to provide an arrangement as indicated in FIG. 4, wherein the receiving bores 34 for the support shaft 6 of the valve operating rocker arms 4 and 7 are disposed in the lower part 10 of the cylinder head and the bearing blocks 8, 9 are individual blocks bolted onto the lower cylinder head part 10. The vertical plane along which the individual bearing blocks are mounted onto lower cylinder head part 10 is in both embodiments preferably the same plane in which the bolts 37 are disposed by which the lower cylinder head part is bolted onto the engine block which is not shown. This vertical mounting plane is preferably disposed in the transition area between adjacent cylinders. In such an arrangement with individual bearing blocks, the bearing eye 34 is preferably formed on the well 30 in the lower part 10 of the cylinder head 11 as shown in FIG. 5.

What is claimed is:

1. A variable valve control arrangement for a piston-type internal combustion engine having a cylinder head including intake and exhaust valves, first and second camshafts mounted on said cylinder head for operating said intake and exhaust valves, said first camshaft having intake valve opening cams and exhaust valve operating cams, said second camshaft having intake valve closing cams, exhaust valve actuating rocker arms pivotally supported on a rocker arm support shaft mounted on said cylinder head in force-transmitting relation with the respective exhaust cams of said first camshaft, intake valve actuating rocker arms also pivotally supported on said rocker arm support shaft for actuating said intake valves, an engagement member disposed on each of said intake valve operating rocker arms and in contact with the intake cams of both camshafts for the transmission of the intake valve opening control movement of said first camshaft and the intake valve closing control movement of the cams of said second camshaft to said intake valves, said rocker arm support shaft being disposed below said first camshaft and being supported by bearing blocks mounted on said cylinder head in the area between adjacent cylinders and also by an additional support structure formed in the middle between two adjacent bearing blocks on a well extending from the cylinder head.

2. A valve control arrangement according to claim 1, wherein said well is disposed sidewardly from the first camshaft toward the exhaust valves.

3. A valve control arrangement according to claim 2, wherein said well is inclined essentially at the same angle as the exhaust valves and is disposed between the exhaust valves.

4. A valve control arrangement according to claim 1, wherein said well is a spark plug well.

5. A valve control arrangement according to claim 1, wherein said well is a fuel injection nozzle well.

6. A valve control arrangement according to claim 1, wherein the intake cams of said first camshaft control the opening of said intake valves.

7. A valve control arrangement according to claim 6, wherein said second camshaft is driven from a drive arrangement for said first camshaft by way of a phase variable transmission.

8. A valve control arrangement according to claim 6, wherein said second camshaft is driven by said first camshaft by way of a phase variable transmission.

9. A valve control arrangement according to claim 8, wherein said first camshaft is driven by a crankshaft of said internal combustion engine.

10. A valve control arrangement according to claim 1, wherein said rocker arm support shaft is disposed in the area of the longitudinal center axis of said internal combustion engine.

11. A valve control arrangement according to claim 10, wherein said engagement members include engagement rollers in contact with said intake cams and said exhaust valve operating rocker arms include engagement rollers in contact with said exhaust cams, said engagement rollers being all disposed at about the same level.

12. A valve control arrangement according to claim 11, wherein said camshafts and said cam operating rocker arms are all arranged in a support housing portion mounted onto a cylinder head part which includes valve guides in which the intake and exhaust valves are supported.

13. A valve control arrangement according to claim 12, wherein the support structure for the shaft supporting said rocker arms is part of said support housing.

14. A valve control arrangement according to claim 12, wherein the support structures for the shaft supporting said rocker arms are mounted onto said cylinder head.

* * * * *